US007089900B2

(12) United States Patent
Masello et al.

(10) Patent No.: US 7,089,900 B2
(45) Date of Patent: Aug. 15, 2006

(54) HYDRAULIC LASH ADJUSTER AND IMPROVED METHOD OF ASSEMBLY THEREOF

(75) Inventors: Jose F. Masello, Battle Creek, MI (US); Majo Cecur, Rivarolo Canavese (IT)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/145,099

(22) Filed: Jun. 3, 2005

(65) Prior Publication Data

US 2005/0224030 A1 Oct. 13, 2005

Related U.S. Application Data

(62) Division of application No. 10/788,083, filed on Feb. 26, 2004, now Pat. No. 6,941,915.

(51) Int. Cl.
*F01L 1/18* (2006.01)

(52) U.S. Cl. ..... 123/90.45; 123/90.39; 123/90.55; 74/569

(58) Field of Classification Search ..... 123/90.39, 123/90.44, 90.45, 90.46, 90.52, 90.55, 90.56; 74/569

See application file for complete search history.

(56) References Cited

U.S. PATENT DOCUMENTS 4,762,100 A * 8/1988 Kowal ..... 123/90.58
5,509,385 A * 4/1996 LaVieri ..... 123/90.35
5,758,613 A * 6/1998 Edelmayer et al. ..... 123/90.35

* cited by examiner

*Primary Examiner*—Thomas Denion
*Assistant Examiner*—Ching Chang
(74) *Attorney, Agent, or Firm*—Bradley J. Diedrich; L. J. Kasper

(57) ABSTRACT

A hydraulic lash adjuster (11) for an internal combustion engine, and an improved method of assembly of such a lash adjuster. The lash adjuster (11) is of the type having a body (13), a plunger (15), and a check valve assembly (17). In accordance with one aspect of the invention, the check valve assembly comprises a cartridge (17A;17B) comprising a member (27;41) separate from the plunger (15) and defining a valve seat (27S;41S). The check valve cartridge is capable of being assembled and tested for compliance with a predetermined relationship of flow versus pressure differential, prior to assembly into the plunger (15). In accordance with the improved method of assembly, a plurality of different bodies (13A;13B) and plungers (15A;15B;15C;15D) is provided, as well as a plurality of different, interchangeable check valve cartridges (17A;17B), and the assembly operator selects a body, a plunger, and a cartridge to provide an assembled lash adjuster having the predetermined, desired operating parameters.

6 Claims, 4 Drawing Sheets

HYDRAULIC LASH ADJUSTER AND IMPROVED METHOD OF ASSEMBLY THEREOF

CROSS-REFERENCE TO RELATED APPLICATIONS

This application is a Divisional Application of application U.S. Ser. No. 10/788,083, filed Feb. 26, 2004, now U.S. Pat. No. 6,941,915, in the name of Jose F. Masello and Majo Cecur for a "Hydraulic Lash Adjuster And Improved Method Of Assembly Thereof".

BACKGROUND OF THE DISCLOSURE

The present invention relates to hydraulic lash adjusters for internal combustion engines, and more particularly, to an improved check valve assembly for use in such lash adjusters, and to an improved method of assembling such lash adjusters.

In a conventional hydraulic lash adjuster (HLA) of the type to which the present invention relates, there is an outer body, which is typically disposed within a mating bore in the engine cylinder head, and disposed within the body is an output plunger assembly engaging a rocker arm. The output plunger assembly may be of either a one-piece or a two-piece construction, and typically, includes a ball plunger element which engages a socket formed in an "underside" surface of the rocker arm. A blind bore formed within the body cooperates with the plunger assembly to define a high pressure chamber, as is well known to those skilled in the art. There is normally a biasing spring seated within the high pressure chamber, biasing the plunger "outward" of the body bore (toward the rocker arm), as is also well known in the HLA art.

Most HLA's which are sold commercially are of the "conventional leakdown" type, in which the radial clearance space between the outer diameter of the plunger and the inner diameter of the body bore forms a leakdown path. This leakdown path (or clearance) permits communication of fluid from the high pressure chamber, through the leakdown clearance, and into the reservoir (or "low pressure" chamber) of the HLA whenever an axial force is transmitted from the rocker arm to the ball plunger.

As is well known to those skilled in the art, one of the key performance criteria of an HLA is the "leakdown" performance of the HLA, i.e., the leakdown flow and resulting plunger assembly travel, as a function of time, for a given force applied to the plunger assembly. For any given engine application, the HLA must provide a leakdown performance which is within a predetermined, specified tolerance range, in order for the HLA to be acceptable for assembly into the engine cylinder head, and in order for the engine valve gear train to operate in a manner which is satisfactory.

In a typical HLA, there is included a check valve assembly, disposed between the high pressure chamber and the low pressure (reservoir) chamber, and operable to control (either to block or to permit) fluid communication between those two chambers, in response to the instantaneous pressure differential between the chambers. Therefore, in the typical HLA, the lower end of the plunger assembly defines a check valve seat, and prior to insertion of the plunger assembly into the HLA body, the check valve assembly (typically consisting of a check ball, a spring, and some sort of retainer) is assembled to the lower end of the plunger assembly.

As is also well known to those skilled in the art, another of the key performance criteria for an HLA is the check valve assembly performance, in terms of the rate of fluid flow from the low pressure chamber into the high pressure chamber (or vice versa), in response to a particular pressure differential between the chambers. Again, for any given engine application, the HLA must provide a check valve assembly performance which is within a predetermined, specified tolerance range, in order for the HLA to be acceptable for assembly into the engine cylinder head, and in order for the engine valve gear train to operate in manner which is satisfactory.

Unfortunately, it occurs periodically that after the HLA is completely assembled, performance testing of the HLA shows that, either the leakdown performance or the check valve assembly performance is not within the specified, permissible limits. When such unacceptable performance occurs, the entire HLA is then either scrapped, (thus wasting several parts of the HLA which, individually, may have been acceptable parts, and therefore, wasting the material, labor and machining costs associated with those parts), or the HLA is sent through some sort of rework process, wherein parts are disassembled, re-inspected, re-sized, and re-assembled. Such a rework process is not only time-consuming, but is also quite expensive.

Although an HLA manufacturer normally produces several different, standard HLA models, each in relatively large volume, it is quite common for an engine manufacturer to request or need an HLA which is nearly identical to one of the standard models, but differs in respect to perhaps only one of the performance criteria, such as the leakdown performance, or the check valve performance, or the plunger travel. When the HLA manufacturer has the opportunity to make and sell such a non-standard HLA, it is then necessary for the HLA manufacturer to design (and provide tooling for) the non-standard part of the HLA, and design and test what then is effectively a whole new HLA design, and a different part number, even though the resulting HLA may have much commonality with an existing model. This approach to designing and manufacturing new HLA models adds substantially to the overall cost of manufacture of the HLA and the lead time to produce the required, non-standard HLA.

BRIEF SUMMARY OF THE INVENTION

Accordingly, it is an object of the present invention to provide an improved hydraulic lash adjuster, and an improved method for assembling such a lash adjuster, which makes it possible to verify the proper performance of the check valve assembly prior to assembly of the entire HLA.

It is another object of the present invention to provide an improved HLA, and an improved method of assembly thereof, in which the performance of the check valve assembly and the leakdown performance each may be changed, independently of the other, without designing and tooling an entirely new HLA.

It is another, related object of the present invention to provide an improved HLA, and a method of assembly thereof, which greatly facilitates the design and production of an HLA which varies, in perhaps only one aspect or performance criteria, from a standard HLA model already designed and tooled and, possibly in production.

The above and other objects of the invention are accomplished by an improved hydraulic lash adjuster for an internal combustion engine, the lash adjuster comprising a body defining a bore therein, a plunger slidingly received within the bore and defining a fluid chamber, the plunger and the bore cooperating to define a pressure chamber, and biasing means normally urging the plunger outward of the bore. The body and the plunger cooperate to define a leakdown clearance providing fluid communication between the pressure chamber and the fluid chamber. A check valve assembly is operably associated with the plunger for permitting or blocking fluid communication between the fluid chamber and the pressure chamber in response to changes in the pressure difference between the chambers. The check valve assembly has a predetermined relationship of permitted fluid communication versus pressure difference.

The improved hydraulic lash adjuster is characterized by the check valve assembly comprising a member, separate from the plunger, the member defining a valve seat. The check valve assembly further comprises a valve member, a spring disposed to bias the valve member toward its normal position, and a retaining member to retain the valve member. The check valve assembly is capable of being assembled and tested for compliance with the predetermined relationship of permitted fluid communication versus pressure difference, prior to installation of the check valve assembly within the plunger.

In accordance with another aspect of the invention, an improved method of assembling a hydraulic lash adjuster is provided, the lash adjuster comprising a body defining a bore therein, a plunger slidingly received within the bore, and defining a fluid chamber. The plunger and the bore cooperate to define a pressure chamber, and biasing means normally urges the plunger outward of the bore. The body and the plunger cooperate to define a leakdown clearance providing fluid communication between the pressure chamber and the fluid chamber. A check valve assembly is operably associated with the plunger for permitting or blocking fluid communication between the fluid chamber and the pressure chamber in response to changes in pressure difference between the chambers.

The improved method of assembly is characterized by (a) providing the body defining the bore; (b) providing a plurality of check valve assemblies, including a first check valve assembly and a second check valve assembly, the first and second check valve assemblies having substantially the same exterior configuration, but differing from each other in some performance criteria; (c) providing a plurality of plungers including a first plunger having a first characteristic and a second plunger having a second characteristic; (d) selecting one of the first and second check valve assemblies; (e) selecting one of the first and second plungers and installing therein the selected check valve assembly; and (f) inserting within the bore of the body the selected plunger and check valve assembly combination.

DETAILED DESCRIPTION OF THE PREFERRED EMBODIMENT

Figure 1:
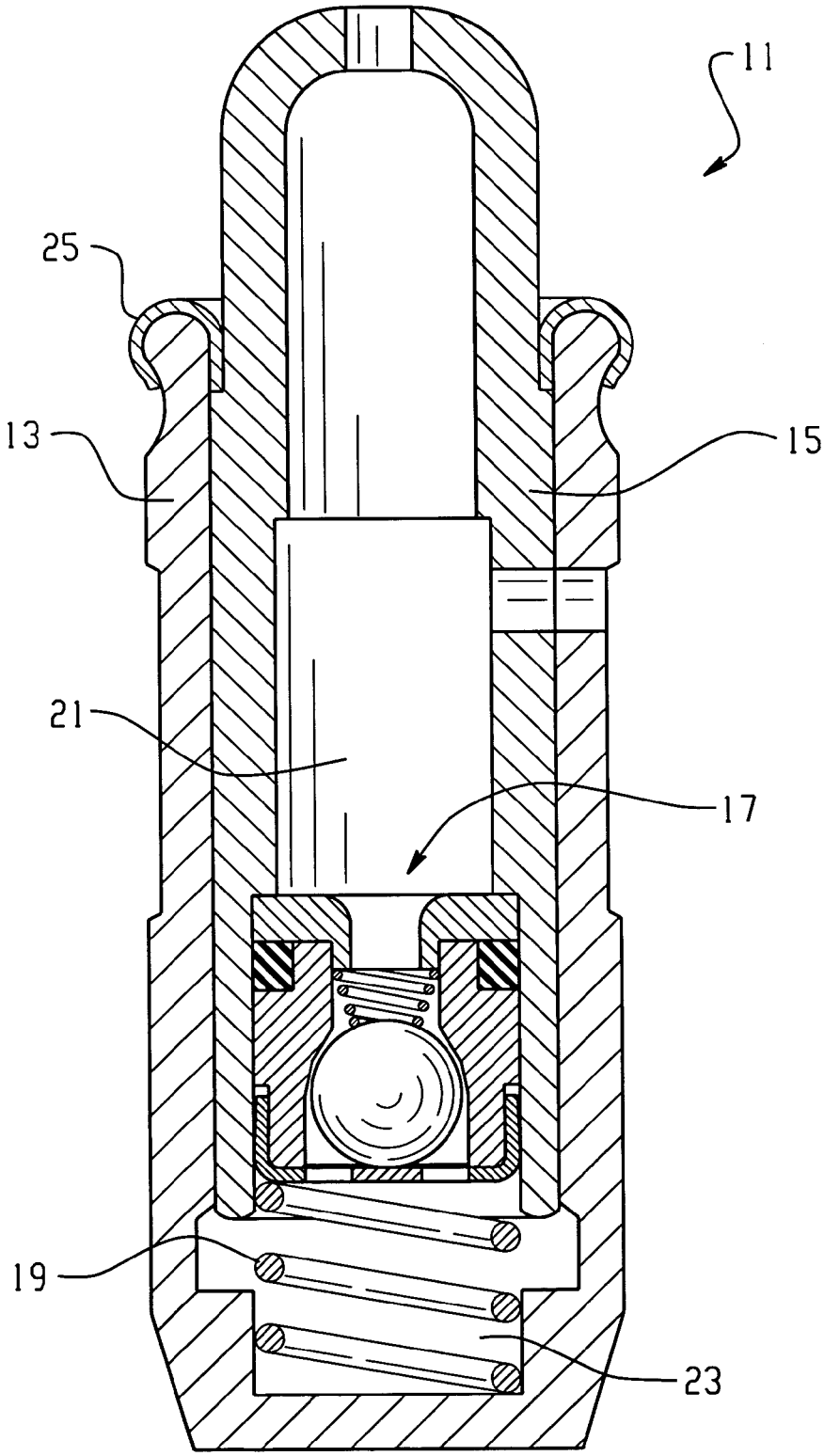
FIG. 1 is an axial cross-section of one particular embodiment of hydraulic lash adjuster, made in accordance with the present invention.

Referring now to the drawings, which are not intended to limit the invention, FIG. 1 is an axial cross-section of one particular embodiment of HLA, by way of example only, made in accordance with the present invention. Therefore, FIG. 1 shows an hydraulic lash adjuster, generally designated 11, which may be of the general type illustrated and described in U.S. Pat. No. 5,855,191, assigned to the assignee of the present invention and incorporated herein by reference. However, those skilled in the art will understand that the present invention, in each of its aspects, is not limited to the particular type of or configuration of HLA shown in FIG. 1, as will be explained in greater detail subsequently.

The HLA 11, as shown in FIG. 1, may be of a general type and configuration well known to those skilled in the art (except where noted otherwise hereinafter), and will be described only briefly at this point. The HLA 11 includes a body 13 which, as noted previously, would typically be disposed within a mating bore in the engine cylinder head (not shown herein). Disposed within the body 13 is a plunger 15, including a check valve assembly, generally designated 17, with the combination of the plunger 15 and the check valve assembly 17 being biased in an "outward" direction (upward in FIG. 1), relative to the body 13, by means of a plunger spring 19. It should be noted that certain reference numerals 13, 15,17, 19, and others to be introduced (with no "A" or "B", etc., attached) will be used at various times hereinafter, and in the appended claims, to refer to the particular element, but in only a generic sense. For example, the generic body in FIG. 1 bears the reference numeral "13", but in FIGS. 3 and 4, there will be illustrated and described two specific bodies 13A and 13B, respectively.

Disposed within the plunger 15 is a fluid chamber 21 (also referred to hereinafter as a "reservoir" or a "low pressure chamber"). The body 13 and the lower end of the plunger 15 cooperate to define a high pressure chamber 23 (also referred to hereinafter, and in the appended claims, as simply the "pressure chamber"). As was mentioned previously, and as is well known to those skilled in the HLA art, the function of the check valve assembly 17 is either to permit fluid communication, or to block fluid communication, between the low pressure chamber 21 and the high pressure chamber 23, in response to the pressure differential between the chambers 21 and 23.

Disposed about the upper end of the body 13 is a cap member 25, the function of which is to retain the plunger 15, and limit outward movement thereof relative to the body 13. It should be understood that the particular configuration of the cap member 25, or even the presence of any cap member, is not an essential feature of the invention, and all that is essential to the invention (as is essential to any HLA) is that there be provided some suitable means for retaining the plunger 15 within the body 13.

Figure 2A:
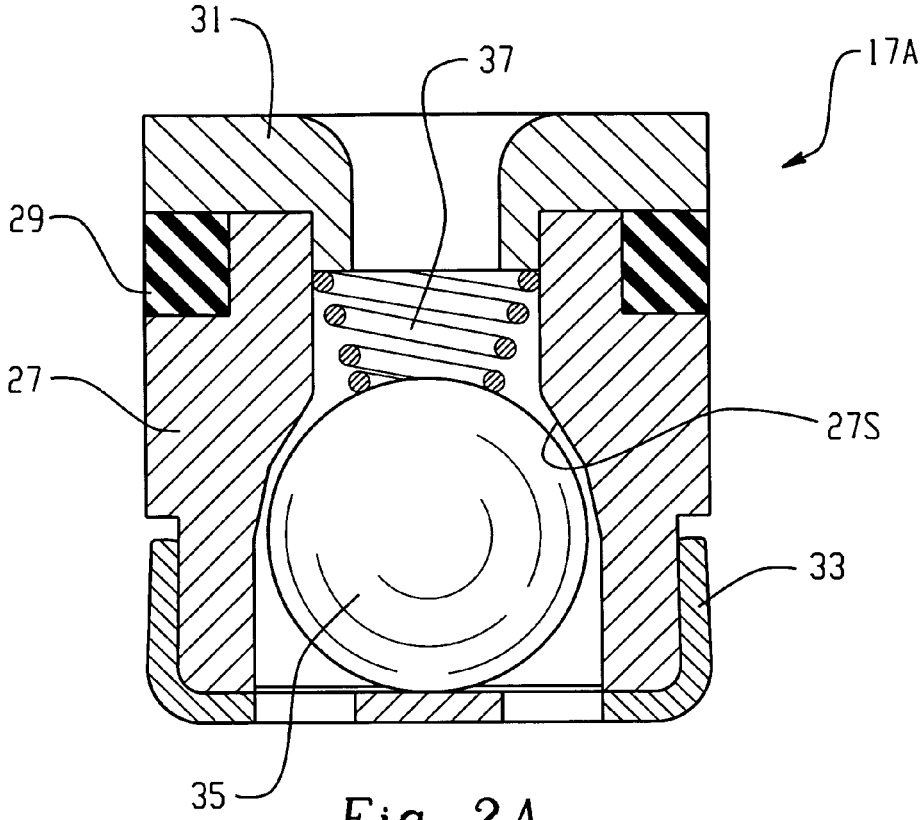
FIG. 2A is an enlarged, axial cross-section of a check valve cartridge of the normally biased-open type, which comprises one aspect of the present invention.
Figure 2B:
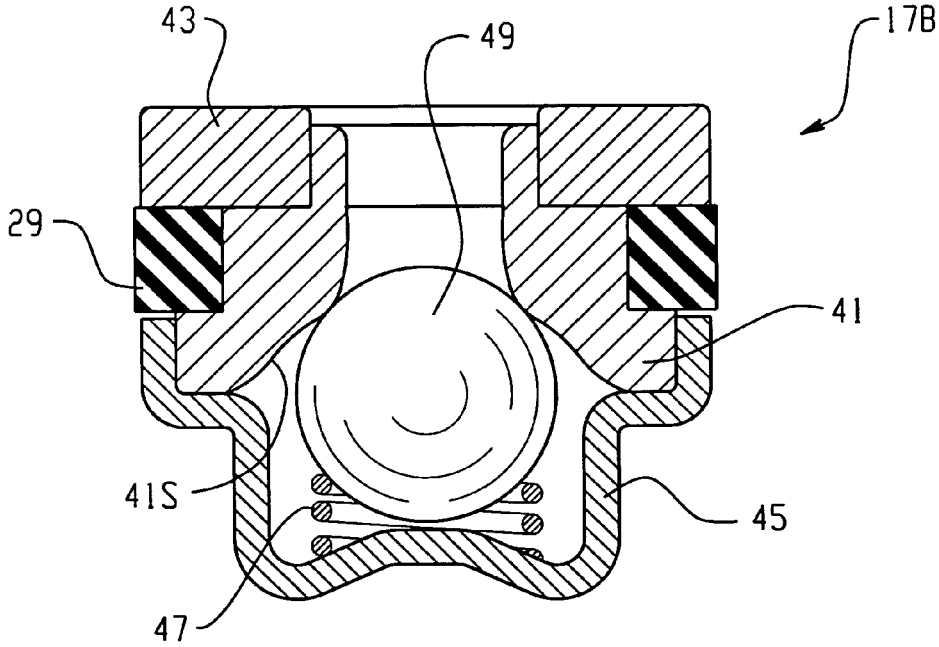
FIG. 2B is an enlarged, axial cross-section of a check valve cartridge of the normally biased-closed type, and on the same scale as FIG. 1.

Referring now primarily to FIGS. 2A and 2B, and in accordance with one important aspect of the present invention, the check valve assembly 17 shown in FIG. 1 comprises a check valve cartridge. In accordance with a further aspect of the invention, there are multiple check valve cartridges provided, from among which one may be selected as part of the method of assembly of the HLA 11. Therefore, but by way of example only, FIG. 2A illustrates a check valve cartridge 17A, while FIG. 2B illustrates a check valve cartridge 17B, it being understood that in accordance with one aspect of the invention, the check valve cartridges 17A and 17B are designed and produced to be "interchangeable" as that term will be explained in greater detail subsequently. One aspect of the check valve cartridges 17A and 17B being interchangeable is that they both have the same exterior configuration which, as may be seen by comparing FIGS. 2A and 2B, means that the cartridges 17A and 17B have the same outside diameters, but clearly not the same overall lengths, at least in the subject embodiment.

Referring now primarily to FIG. 2A, the check valve cartridge 17A comprises a generally cylindrical seat member 27, defining a check valve seat surface 27S. Disposed about the seat member 27, at the upper end thereof, is a seal member 29 which may comprise any of the materials now conventionally used for HLA seals. The seal member 29 is retained in place as shown in FIG. 2A by means of a retention and seat member 31 which, preferably, has an interference fit with the upper portion of the inside diameter of the seat member 27.

Referring still to FIG. 2A, disposed at the lower end of the seat member 27 is a retainer 33, which would normally be crimped in place, relative to the seat member 27, as shown in FIG. 2A. As is well known to those skilled in the art, one function of the retainer 33 is to retain, and limit axial travel of, a check ball 35 which is biased toward an open position (away from the seat surface 27S) by a compression spring 37. Thus, the check valve cartridge 17A is of the type referred to as "normally biased open", in accordance with the teachings of U.S. Pat. No. 5,758,613, assigned to the assignee of the present invention and incorporated herein by reference.

Referring now primarily to FIG. 2B, the check valve cartridge 17B includes a seat member 41, defining a seat surface 41S, and disposed around the seat member 41 is a seal member which, in the subject embodiment, and by way of example only, is (or at least, may be) the same seal member 29 used in the cartridge 17A. The seal member 29 is retained in place by means of a retention member 43 which, on its inside diameter, has an interference fit with an adjacent outer surface of the seat member 41.

A retainer 45 is in engagement, such as by crimping or any other suitable means, with a lower portion of the seat member 41. Seated against the upper surface of the retainer 45 is a compression spring 47 which engages a check ball 49 and biases it toward the seat surface 41S. Therefore, the check valve cartridge 17B is of the type referred to as "normally biased closed", as has been well known in the HLA art for many years.

In accordance with one important aspect of the present invention, as the check valve cartridges 17A are produced, each one may be placed in an appropriate test fixture, and subjected to one or more predetermined pressure differentials, while the test fixture measures the permitted fluid flow past the check ball 35 to verify that, for any given pressure differential, the rate of fluid flow is within the predetermined tolerance range. Similarly, as each of the check valve cartridges 17B is produced, it may be placed in its own test fixture, and subjected to one or more pressure differentials across the check ball 49, while the fixture measures the rate of fluid flow, again to verify that for each pressure differential, the fluid flow is within the predetermined tolerance range.

After each check valve cartridge (17A or 17B) is tested, if it meets all of the check valve performance criteria specified for that particular cartridge, it then proceeds to the HLA assembly area. Those cartridges which do not meet all of the performance criteria are rejected (and possibly scrapped) at this stage of the process, rather than after the entire HLA is assembled and tested, as has been the case in connection with the prior art hydraulic lash adjusters and the prior art methods of assembly thereof.

Although the present invention is being illustrated and described in connection with an embodiment in which one of the available check valve assemblies is normally biased open, and the other is normally biased closed, those skilled in the HLA art will recognize that the invention is not so limited. In the broadest aspects of the method of assembling an HLA, all that is essential is that at least two different check valve assemblies be available, and that the two assemblies differ from each other in some performance criteria. For example, in the HLA assembly area, there could be provided two (or more) different types of check valve cartridge, wherein both are, for example, of the normally biased open type, but wherein the first cartridge (17A) has one particular check ball size and/or travel, while the second cartridge (not shown herein) has a different check ball size and/or travel. Or, as another example, there could be provided two (or more) different types of check valve cartridge wherein both are of the normally biased-closed type, but wherein one (17B) has one particular bias force for the spring 47, while the other (not shown herein) has a different bias force for the spring 47.

Figure 3B:
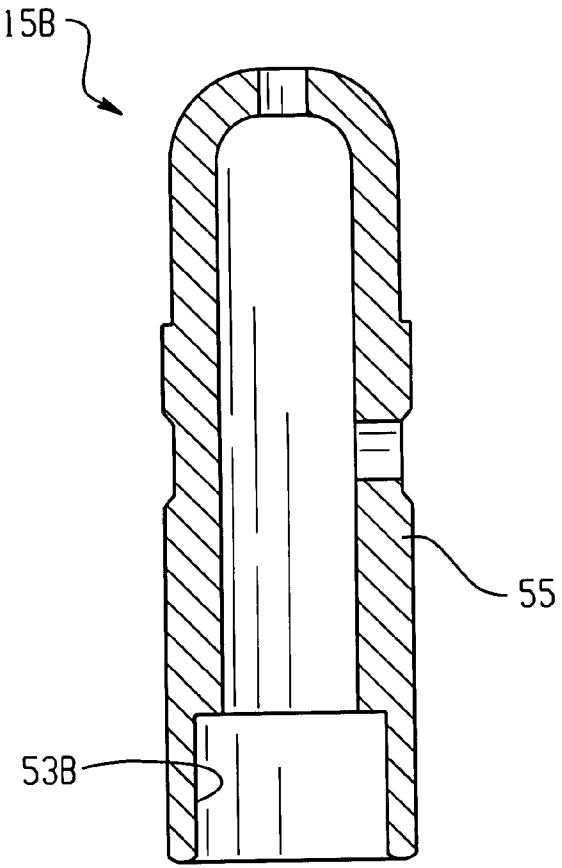
FIGS. 3A and 3B are axial cross-sections of lash adjuster plungers useable with the body of FIG. 3, and on the same scale as FIG. 3.
Figure 3A:
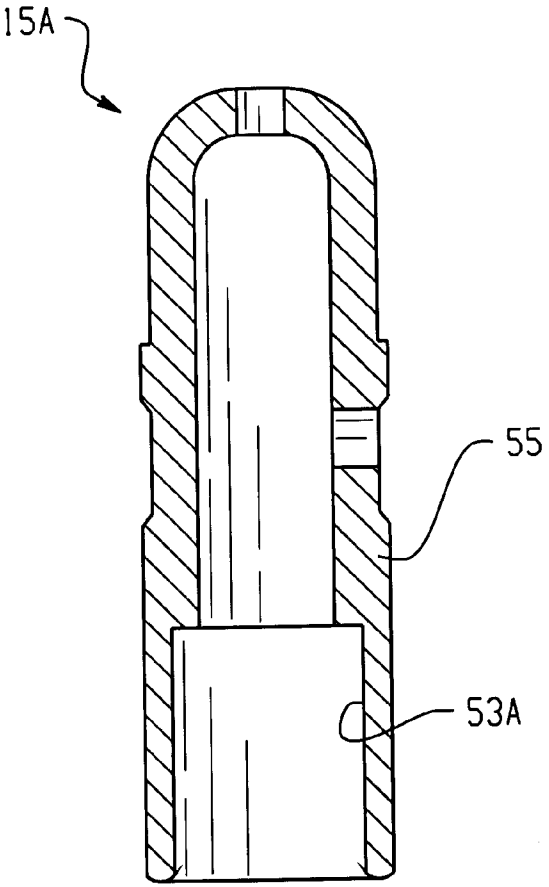
Figure 3:
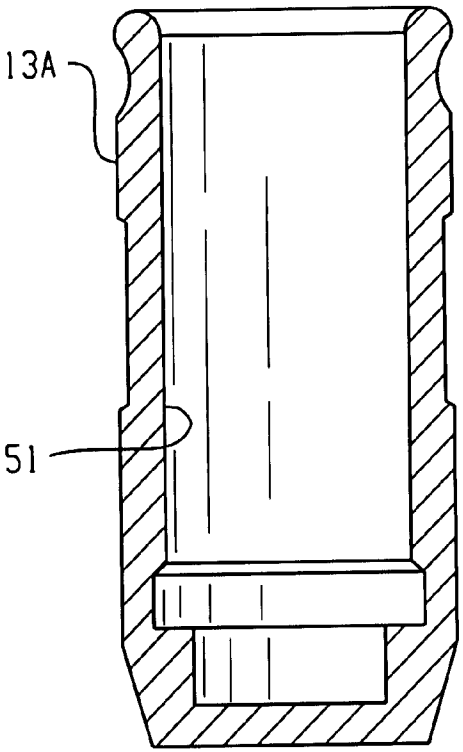
FIG. 3 is an axial cross-section of a hydraulic lash adjuster body, on a substantially smaller scale than FIGS. 2A and 2B.
Figure 4B:
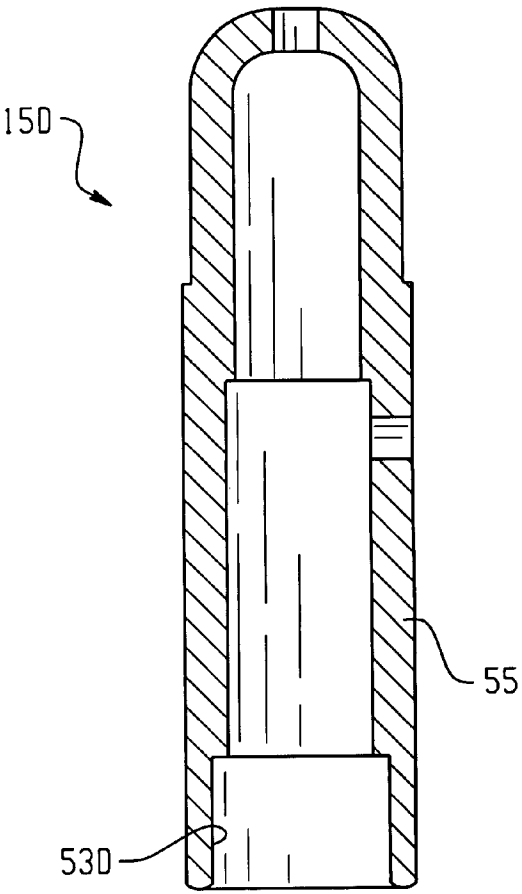
FIGS. 4A and 4B are axial cross-sections of plungers useable with the body of FIG. 4, and on the same scale as FIG. 4.
Figure 4A:
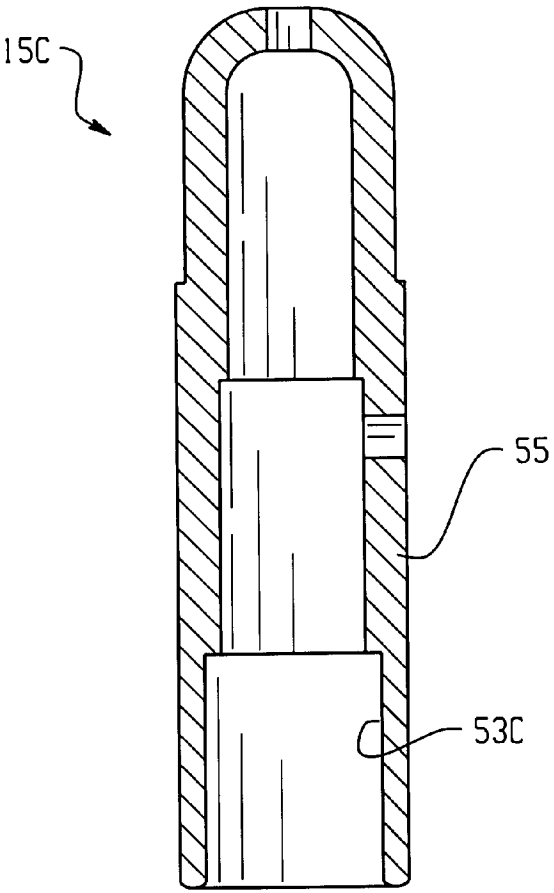
Figure 4:
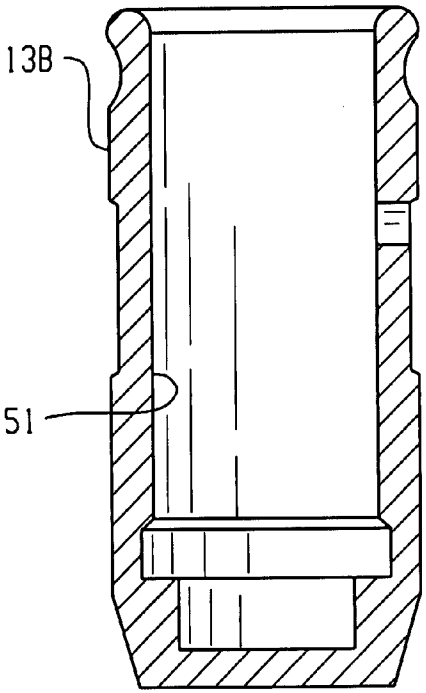
FIG. 4 is an axial cross-section of a hydraulic lash adjuster body which is different than that shown in FIG. 3, but on the same scale.

Referring now primarily to FIGS. 3 and 4, there is shown in FIG. 3 a short HLA body 13A and there is shown in FIG. 4 a long HLA body 13B. By way of example only, the short body 13A and the long body 13B may be substantially identical, except for the overall length, and therefore each defines a body bore 51, and in the subject embodiment, and by way of example only, the body bores 51 of both of the bodies 13A and 13B are identical in diameter, the significance of which will be described subsequently.

Referring now primarily to FIGS. 3A and 3B, there are illustrated short plungers 15A and 15B, respectively which, for purposes of the present invention, may be substantially identical in parameters such as overall length, outside diameter 55, etc. However, in the subject embodiment, and by way of example only, the short plunger 15A defines a cartridge recess 53A which is adapted to receive therein the check valve cartridge 17A, shown in FIG. 2, while the short plunger 15B defines a relatively shorter cartridge recess 53B adapted to receive therein the relatively shorter check valve cartridge 17B, shown in FIG. 2B. As noted above, the short plunger 15A and the short plunger 15B could have exactly the same outside diameters 55, in which case, each would cooperate with the body bore 51 of the short body 13A to provide the same leakdown clearance.

Referring now primarily to FIGS. 4A and 4B, there is shown a pair of long plungers 15C and 15D, respectively which, as was explained in connection with FIGS. 3A and 3B, may be substantially identical to each other in terms of overall length and outside diameter 55, but in the subject embodiment, and by way of example only, differ from each other at least in regard to the fact that the long plunger 15C defines a cartridge recess 53C whereas the long plunger 15D defines a relatively shorter cartridge recess 53D. In the subject embodiment, and by way of example only, the cartridge recess 53C is substantially identical to the cartridge recess 53A, and therefore, is configured to receive therein the check valve cartridge 17A, whereas, the cartridge recess 53D is substantially identical to the cartridge recess 53B, and therefore, is configured to receive therein the relatively shorter check valve cartridge 17B.

It should be understood by those skilled in the art that, within the scope of the invention, the different check valve cartridges could all be configured to have the same axial length, thus eliminating the need to provide both of the short plungers 15A and 15B, or both of the long plungers 15C and 15D. However, the invention is being described in connection with an embodiment in which the check valve cartridges are different (and require different plungers) to help illustrate the flexibility in design afforded by the invention. Also, and as is now well known in the HLA art, the shorter plungers 15A and 15B would typically be utilized in markets which require relatively less plunger travel, as is now the case normally in the European market. On the other hand, the longer plungers 15C and 15D would typically be utilized in markets which require relatively greater plunger travel, as is now the case normally in the North American market.

In accordance with another important aspect of the present invention, there is provided the ability to assemble a number of different HLA models, each being different from the others in at least one aspect of its configuration or its performance criteria, but without the cost required for each different model of HLA to be comprised of parts and components which are completely unique to that particular model.

Therefore, and by way of example only, the short bodies 13A and long bodies 13B would be formed and machined, etc., and sent to the HLA assembly area, and the short plungers 15A and 15B and the long plungers 15C and 15D would also be formed and machined, etc. and also sent to the HLA assembly area. After the check valve cartridges 17A and 17B are assembled and tested, those which successfully pass the performance test would be sent to the HLA assembly area as was mentioned previously. In the HLA assembly area, it is then possible to assemble a number of different HLA models utilizing those opponents shown in FIGS. 2 through 4.

For example, the assembly operator would select one of the long bodies 13B, as shown in FIG. 4. The assembly operator would then select one of the check valve cartridges 17A, and one of the long plungers which is suitable for use with the cartridge 17A, i.e., one of the long plungers 15C. The assembly operator would then install the selected check valve cartridge 17A within the selected long plunger 15C, and then install within the body 13B the assembled cartridge-plunger sub-assembly or combination. As is well known to those skilled in the art, just prior to installing the cartridge-plunger combination, it is necessary to put in place the plunger spring 19 (shown only in FIG. 1). In accordance with another aspect of this invention, there may be available to the assembly operator several different plunger springs (19A and 19B, not shown herein because both are represented generically by the spring 19 in FIG. 1), each having a different biasing characteristic (for example, a different "curve" of biasing force as a function of axial compression). Thus, two different HLA models could be provided simply by having available two different plunger springs 19.

Although, for ease and simplicity of illustration, only two bodies (13A and 13B) have been shown and described herein, in which the only difference between them is the length, those skilled in the art will understand that other body configurations could be utilized. For example, a plurality of the normally-closed check valve cartridges 17B could be assembled into a plurality of the short plungers 15B, and then these cartridge-plungers combinations installed in the bodies of deactivating HLA's of the type which are now well know to those skilled in the HLA art.

For each different HLA assembly to be designed and assembled, it is necessary to start by specifying the check valve cartridge type (normally-biased open; normally-biased closed, or "free ball", as that term is understood in the art) and check valve performance. Based upon that determination, the next step is to select the appropriate check valve cartridge (either 17A or 17B, etc.) from among the multiple cartridge models available. Next, the designer must specify the desired leakdown performance, and based upon that, select the appropriate plunger which "accepts" the selected check valve cartridge and at the same time, cooperates with the body to be used to provide the desired leakdown performance. The invention has been illustrated and described based upon the assumption that the different desired leakdown clearances may be achieved by selecting from among several different plungers, having slightly different diameters. However, it should be apparent that the same result could be achieved by having available several different bodies, each having a slightly different body bore diameter.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic lash adjuster for an internal combustion engine, said lash adjuster comprising a body defining a bore therein, a plunger slidingly received within said bore and defining a fluid chamber, said plunger and said bore cooperating to define a pressure chamber, biasing means normally urging said plunger outward of said bore, said body and said plunger cooperating to define a leakdown clearance providing fluid communication between said pressure chamber and said fluid chamber, and a check valve assembly operably associated with said plunger and fixed relative to said plunger to move therewith, for permitting or blocking fluid communication between said fluid chamber and said pressure chamber in response to changes in the pressure difference between said chambers, said check valve assembly having a predetermined relationship of permitted fluid communication versus pressure difference; characterized by:

(a) said check valve assembly being installed within said plunger and comprising a member, separate from said plunger, said member defining a valve seat;

(b) said check valve assembly further comprising a valve member, and a retaining member to retain said valve member; whereby (c) said check valve assembly is capable of being assembled and tested for compliance with said predetermined relationship of permitted fluid communication versus pressure difference, prior to installation of said check valve assembly within said plunger.

2. A hydraulic lash adjuster as claimed in claim 1, characterized by said check valve assembly having said valve member biased away from said valve seat by a spring toward an open position, said open position comprising a normal position.

3. A hydraulic lash adjuster as claimed in claim 1, characterized by said check valve assembly having said valve member biased toward said valve seat by a spring toward a closed position, said closed position comprising a normal position.

4. A hydraulic lash adjuster as claimed in claim 1, characterized by said plunger defining a cartridge recess which opens in the direction of said pressure chamber, said check valve assembly comprising a cartridge adapted for assembly within said cartridge recess, to be fixed therein relative to said plunger.

5. A hydraulic lash adjuster as claimed in claim 1, characterized by said check valve assembly including a retention member operably associated with said member defining said valve seat whereby said check valve assembly is retained in its assembled condition.

6. A hydraulic lash adjuster as claimed in claim 5, characterized by said retention member and said member defining said valve seat are operably associated by means of an interference fit between an inside diameter of one of said members and an outside diameter of the other of said members.

* * * * *